US011944117B2

(12) United States Patent
Yamamoto et al.

(10) Patent No.: US 11,944,117 B2
(45) Date of Patent: Apr. 2, 2024

(54) METHOD FOR MANUFACTURING HEATED CIGARETTE PRODUCT

(71) Applicant: JAPAN TOBACCO INC., Tokyo (JP)

(72) Inventors: Norio Yamamoto, Tokyo (JP); Shigehiro Toyoshima, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 352 days.

(21) Appl. No.: 17/219,431

(22) Filed: Mar. 31, 2021

(65) Prior Publication Data

US 2021/0212357 A1 Jul. 15, 2021

Related U.S. Application Data

(63) Continuation of application No. PCT/JP2019/036045, filed on Sep. 13, 2019.

(30) Foreign Application Priority Data

Oct. 5, 2018 (WO) ..... PCT/JP2018/037340

(51) Int. Cl.
*A24C 5/56* (2006.01)
*A24C 5/00* (2020.01)
(Continued)

(52) U.S. Cl.
CPC ..... *A24C 5/565* (2013.01); *A24C 5/005* (2013.01); *A24C 5/472* (2013.01); *A24C 5/586* (2013.01)

(58) Field of Classification Search
CPC ..... A24F 40/40; A24F 13/02; A24F 17/00; A24F 15/08; A24F 19/105; A24F 15/02;
(Continued)

(56) References Cited

U.S. PATENT DOCUMENTS 4,035,220 A 7/1977 Hammersmith
4,249,547 A * 2/1981 Hinzmann ..... A24C 5/472 131/69
(Continued)

FOREIGN PATENT DOCUMENTS

EP 2412256 A1 * 2/2012 ..... A24F 17/00
EP 3 075 288 A1 10/2016
(Continued)

OTHER PUBLICATIONS

Parcevaux Philippe, Packs of cigarette paper including improved marking—English Translation, May 4, 2023, European Patent Office, ( Year: 2023).*
(Continued)

*Primary Examiner* — Eric Yaary
(74) *Attorney, Agent, or Firm* — Birch, Stewart, Kolasch & Birch, LLP

(57) ABSTRACT

A method of manufacturing a smoking article that contains, as members, at least a tobacco rod, a cooling segment, and a filter segment and in which a low-stiffness member L and a high-stiffness member H are adjacent to each other, the method includes (A) placing an adhesive on either surface of a tipping paper to form each portion of a high adhesive weight and a low adhesive weight per unit area after solidification, where the portion of a high adhesive weight is provided in a region for wrapping the member L; and (B) preparing a composite segment that contains at least the tobacco rod, the cooling segment, and the filter segment and wrapping the composite segment in the tipping paper.

35 Claims, 11 Drawing Sheets

(1)

(2)

(51) Int. Cl.
*A24C 5/47* (2006.01)
*A24C 5/58* (2006.01)

(58) Field of Classification Search
CPC .. A24F 13/14; A24F 42/80; A24F 9/00; A24F 19/10; A24F 40/70; A24F 40/95; A24D 1/02; A24D 1/20; A24C 5/006; A24C 5/01; A24C 5/472; A24C 5/565; A24C 5/586
See application file for complete search history.

(56) References Cited

U.S. PATENT DOCUMENTS

| | | | | |
|---|---|---|---|---|
| 2001/0032697 | A1 | 10/2001 | Maiwald et al. | |
| 2009/0114234 | A1 * | 5/2009 | Nelson | A24C 5/471 131/77 |

FOREIGN PATENT DOCUMENTS

| | | | | |
|---|---|---|---|---|
| EP | 3075266 | A1 * | 10/2016 | A24B 15/12 |
| GB | 1 447 191 | A | 8/1976 | |
| GB | 1447191 | A * | 8/1976 | A24C 5/472 |
| WO | WO 2017/198838 | A1 | 11/2017 | |

OTHER PUBLICATIONS

Extended European Search Report for corresponding European Application No. 18936181.9, dated Apr. 22, 2022.
International Search Report for PCT/JP2019/036045 (PCT/ISA/210) dated Dec. 17, 2019.
Korean Ofice Action dated Aug. 24, 2023 for Application No. 10-2021-7013142 with an English translation.

* cited by examiner (2)

(1)

METHOD FOR MANUFACTURING HEATED CIGARETTE PRODUCT

CROSS REFERENCE TO RELATED APPLICATIONS

The present application is a continuation application of International Application No. PCT/JP2019/036045, filed on Sep. 13, 2019, which claims priority under 35 U.S.C. 119(a) to Patent Application No. PCT/JP2018/037340, filed in Japan on Oct. 5, 2018, all of which are hereby expressly incorporated by reference into the present application.

TECHNICAL FIELD

The present invention relates to a method of manufacturing a heat-not-burn smoking article.

BACKGROUND ART

A heat-not-burn smoking article, such as an electrically heated cigarette, has been under investigation. For example, Patent Literature (PTL) 1 discloses a heat-not-burn smoking article that includes a paper tube adjacent to a tobacco rod.

CITATION LIST

Patent Literature

PTL 1: WO 2017/198838

SUMMARY OF INVENTION

Technical Problem

Different from a common combustion-type smoking article, a heat-not-burn smoking article includes members different in properties, such as stiffness. For this reason, when a heat-not-burn smoking article is manufactured by uniformly applying an adhesive to a tipping paper, failures, such as slipping off of part of the members and crease formation in a product, arise. In particular, slipping off of a heated tobacco rod poses a safety problem. In view of the above, an object of the present invention is to provide a method of manufacturing a heat-not-burn smoking article having reduced crease formation and slipping off of a member.

Solution to Problem

The inventors resolved the above-mentioned problems by optimizing the amount of an adhesive in a specific region of a tipping paper. In other words, the above-mentioned problems are resolved by the present invention below.

(Embodiment 1) A method of manufacturing a smoking article that contains, as members, at least a tobacco rod, a cooling segment, and a filter segment and in which a low-stiffness member 1, and a high-stiffness member H are adjacent to each other, the method including (A) placing an adhesive on either surface of a tipping paper to form each portion of a high adhesive weight and a low adhesive weight per unit area after solidification, where the portion of a high adhesive weight is provided in a region for wrapping the member L; and (B) preparing a composite segment that contains at least the tobacco rod, the cooling segment, and the filter segment and wrapping the composite segment in the tipping paper.

(Embodiment 2) The method according to Embodiment 1, where an adhesive weight in the portion of a high adhesive weight is 1.5 to 3 times an adhesive weight in the portion of a low adhesive weight.

(Embodiment 3) The method according to Embodiment 1 or 2, where in a step of A, the portion of a high adhesive weight is provided in a region extending from a contact face between the member L and the member H to a 20 to 40% position of the member L in the longitudinal direction.

(Embodiment 4) The method according to any of Embodiments 1 to 3, where in a step of A, a non-adhesive portion is provided at the leading end of the tipping paper, which is defined as a tipping paper region positioned at the end on the side opposite to the mouth end when the tipping paper is wrapped around.

(Embodiment 5) The method according to any of Embodiments 1 to 4, where in a step of A, a non-adhesive portion is provided in a region of the tipping paper for wrapping the cooling segment or the filter segment.

(Embodiment 6) The method according to any of Embodiments 1 to 5, where the composite segment in a step of B is a double-length composite segment prepared by placing a pair of the composite segments such that filter segment end faces come into contact with each other.

(Embodiment 7) The method according to Embodiment 6, where a non-adhesive portion is provided near a region for wrapping a contact part between the filter segment end faces.

(Embodiment 8) The method according to Embodiment 5, further including providing a hole in the non-adhesive portion.

(Embodiment 9) The method according to Embodiment 5 or 8, further including performing printing in the non-adhesive portion.

(Embodiment 10) The method according to any of Embodiments 1 to 9, where the member L has a diameter larger than the member H.

(Embodiment 11) The method according to Embodiment 10, Where the member L has a diameter 0.05 to 0.15 mm larger than the member H.

(Embodiment 12) The method according to Embodiment 10, where the member L has a diameter 0.5 to 2.5% larger than the member H.

(Embodiment 13) A smoking article including, as members, at least a tobacco rod, a cooling segment in contact with the tobacco rod, a filter segment, and a tipping paper for wrapping the tobacco rod, the cooling segment, and the filter segment and including a low-stiffness member L adjacent to a high-stiffness member H, where the tipping paper has each portion of a high adhesive weight and a low adhesive weight per unit area after solidification; and the tipping paper includes the portion of a high adhesive weight in a region for wrapping the member L.

(Embodiment 14) The smoking article according to Embodiment 13, where an adhesive weight in the portion of a high adhesive weight is 1.5 to 3 times an adhesive weight in the portion of a low adhesive weight.

(Embodiment 15) The smoking article according to Embodiment 13 or 14, where the tipping paper has a non-adhesive portion in a region for wrapping the cooling segment.

(Embodiment 16) The smoking article according to any of Embodiments 13 to 15, where the tipping paper has a non-adhesive portion in a region for wrapping the filter segment.

(Embodiment 17) The method according to any of Embodiments 1 to 12, where the member L is the cooling segment.

(Embodiment 18) The method according to any of Embodiments 1 to 12 and 17, where the member H is the filter segment.

(Embodiment 19) A method of manufacturing a smoking article that contains, as members, at least a tobacco rod, a cooling segment, and a filter segment, including (A') placing an adhesive on either surface of a tipping paper to form each portion of a high adhesive weight and a low adhesive weight per unit area after solidification, where the portion of a high adhesive weight is provided in a region for wrapping the tobacco rod; and (B') preparing a composite segment that contains at least the tobacco rod, the cooling segment, and the filter segment and wrapping the composite segment in the tipping paper.

(Embodiment 20) The method according to Embodiment 19, where an adhesive weight in the portion of a high adhesive weight is 1.5 to 3 times an adhesive weight in the portion of a low adhesive weight.

(Embodiment 21) The method according to Embodiment 19 or 20, where in a step of A', the portion of a high adhesive weight is provided in a region extending from a contact face between the tobacco rod and a member neighboring the tobacco rod to a 20 to 40% position of the tobacco rod in the longitudinal direction.

(Embodiment 22) The method according to any of Embodiments 19 to 21, where the smoking article has the tobacco rod at the leading end; and in a step of A', a non-adhesive portion is provided at the leading end of the tipping paper, which is defined as a tipping paper region positioned over the end of the tobacco rod when the tipping paper is wrapped around the composite segment.

(Embodiment 23) The method according to any of Embodiments 19 to 22, where in a step of A', a non-adhesive portion is provided in a region for wrapping the cooling segment.

(Embodiment 24) The method according to any of Embodiments 19 to 23, where the composite segment in a step of B' is a double-length composite segment prepared by placing a pair of the composite segments such that filter segment end faces come into contact with each other.

(Embodiment 25) The method according to Embodiment 24, where a non-adhesive portion is provided near a region in the tipping paper for wrapping a contact part between the filter segment end faces.

(Embodiment 26) The method according to Embodiment 23, further including providing a hole in the non-adhesive portion.

(Embodiment 27) The method according to Embodiment 23 or 26, further including performing printing in the non-adhesive portion.

(Embodiment 28) The method according to any of Embodiments 19 to 27, where the tobacco rod has a diameter larger than a neighboring member.

(Embodiment 29) The method according to Embodiment 28, where the tobacco rod has a diameter 0.05 to 0.15 mm larger than the neighboring member.

(Embodiment 30) The method according to Embodiment 28, where the tobacco rod has a diameter 0.5 to 2.5% larger than the neighboring segment.

(Embodiment 31 The method according to any of Embodiments 19 to 30, where the member neighboring the tobacco rod has stiffness higher than the tobacco rod.

(Embodiment 32) The method according to any of Embodiments 19 to 31, where the member neighboring the tobacco rod is the cooling segment or a support segment.

(Embodiment 33) A smoking article including, as members, at least a tobacco rod, a cooling segment, a filter segment, and a tipping paper for wrapping the tobacco rod, the cooling segment, and the filter segment, where the tipping paper has each portion of a high adhesive weight and a low adhesive weight per unit area after solidification; and the tipping paper includes the portion of a high adhesive weight in a region for wrapping the tobacco rod.

(Embodiment 34) The smoking article according to Embodiment 33, where an adhesive weight in the portion of a high adhesive weight is 1.5 to 3 times an adhesive weight in the portion of a low adhesive weight.

(Embodiment 35) The smoking article according to Embodiment 33 or 34, where the tipping paper has a non-adhesive portion in a region for wrapping the cooling segment.

(Embodiment 36) The smoking article according to any of Embodiments 32 to 35, where the tipping paper has a non-adhesive portion in a region for wrapping the filter segment.

(Embodiment 37) The smoking article according to any of Embodiments 33 to 36, where a member neighboring the tobacco rod is the cooling segment or a support segment.

(Embodiment a1) A method of manufacturing a smoking article that contains, as members, at least a tobacco rod, a cooling segment, and a filter segment and in which a low-stiffness member L and a high-stiffness member H are adjacent to each other, the method including (A") placing an adhesive on either surface of a tipping paper to form each portion of a high adhesive weight and a low adhesive weight per unit area after solidification, where the portion of a high adhesive weight is provided in a region for wrapping the member L; and (B") preparing a composite segment that contains at least the tobacco rod, the cooling segment, and the filter segment and wrapping the composite segment in the tipping paper, where the member L is a member excluding the tobacco rod.

(Embodiment a2) The method according to Embodiment a1, where an adhesive weight in the portion of a high adhesive weight is 1.5 to 3 times an adhesive weight in the portion of a low adhesive weight.

(Embodiment a3) The method according to Embodiment a1 or a2, where in a step of A", the portion of a high adhesive weight is provided in a region extending from a contact face between the member L and the member H to a 20 to 40% position of the member L in the longitudinal direction.

(Embodiment a4) The method according to any of Embodiments a1 to a3, where the smoking article has the tobacco rod at the leading end; and in a step of A", a non-adhesive portion is provided at the leading end of the tipping paper, which is defined as a tipping paper region positioned over the end of the tobacco rod when the tipping paper is wrapped around.

(Embodiment a5) The method according to any of Embodiments a1 to a4, where in a step of A", a non-adhesive portion is provided in a region of the tipping paper for wrapping the cooling segment or the filter segment.

(Embodiment a6) The method according to any of Embodiments a1 to a5, where the composite segment in a step of B" is a double-length composite segment prepared by placing a pair of the composite segments such that filter segment end faces come into contact with each other.

(Embodiment a7) The method according to Embodiment a6, where a non-adhesive portion is provided near a region for wrapping a contact part between the filter segment end faces.

(Embodiment a8) The method according to Embodiment a5, further including providing a hole in the non-adhesive portion.

(Embodiment a9) The method according to Embodiment a5 or a8, further including performing printing in the non-adhesive portion.

(Embodiment a10) The method according to any of Embodiments a1 to a9, where the member L has a diameter larger than the member H.

(Embodiment a11) The method according to Embodiment a10, where the member L has a diameter 0.05 to 0.15 mm larger than the member H.

(Embodiment a12) The method according to Embodiment a10, where the member L has a diameter 0.5 to 2.5% larger than the member H.

(Embodiment a13) A smoking article including, as members, at least a tobacco rod, a cooling segment, a filter segment, and a tipping paper for wrapping the tobacco rod, the cooling segment, and the filter segment and including a low-stiffness member L (excluding the tobacco rod) adjacent to a high-stiffness member H, where the tipping paper has each portion of a high adhesive weight and a low adhesive weight per unit area after solidification; and the tipping paper includes the portion of a high adhesive weight in a region for wrapping the member L.

(Embodiment a14) The smoking article according to Embodiment a13, where an adhesive weight in the portion of a high adhesive weight is 1.5 to 3 times an adhesive weight in the portion of a low adhesive weight.

(Embodiment a15) The smoking article according to Embodiment a13 or a14, where the tipping paper has a non-adhesive portion in a region for wrapping the cooling segment.

(Embodiment a16) The smoking article according to any of Embodiments a13 to a15, where the tipping paper has a non-adhesive portion in a region for wrapping the filter segment.

(Embodiment a17) The method according to any of Embodiments a1 to a12, where the member L is the cooling segment.

(Embodiment a18) The method according to any of Embodiments a1 to a12 and a17, where the member H is the filter segment.

Advantageous Effects of Invention

According to the present invention, it is possible to provide a method of manufacturing a heat-not-burn smoking article having reduced crease formation and slipping off of a member.

DESCRIPTION OF EMBODIMENTS

In a smoking article having the sequence of a low-stiffness member adjacent to a high-stiffness member, the inventors found possible to suppress, for example, slipping off of the low-stiffness member by increasing the amount of an adhesive in a region of a tipping paper for Tapping the low-stiffness member. Meanwhile, in view of safety, it is necessary to reliably suppress slipping off of a tobacco rod. Fax this purpose, the inventors also found useful to increase the amount of an adhesive in a region of a tipping paper for wrapping a tobacco rod regardless of the stiffness value of the tobacco rod. Hereinafter, the present invention will be described in detail. In the present invention, the expression "X to Y" includes the lower and the upper limits of X and Y.

I. First Method

1. First Heat-not-Burn Smoking Article

A first heat-not-burn smoking article (hereinafter, also simply referred to as "first smoking article") of the present invention includes, as members, at least a tobacco rod, a cooling segment, and a filter segment and has the sequence of a low-stiffness member L adjacent to a high-stiffness member H. The first heat-not-burn smoking article may or may not encompass an embodiment in which a tobacco rod as the low-stiffness member L is adjacent to another member (cooling segment, for example) as the high-stiffness member H. However, such an embodiment in which a tobacco rod as the member L is adjacent to the high-stiffness member H (cooling segment, for example) is encompassed in a second heat-not-burn smoking article of the present invention. Accordingly, the embodiment will be described in the next section and thus omitted in the description of the first heat-not-burn smoking article.

Figure 1:
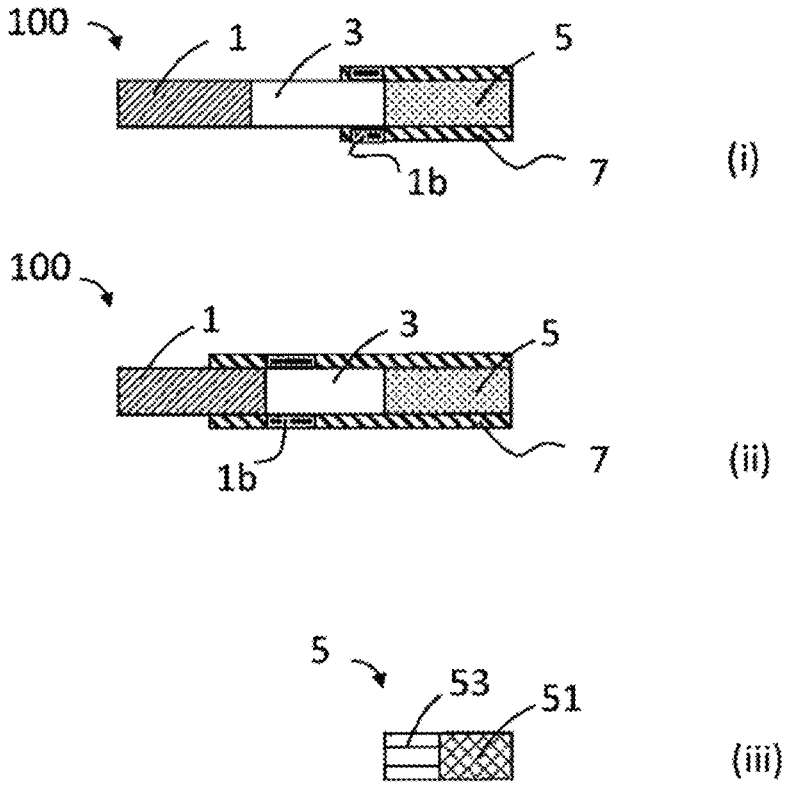
FIG. 1 illustrates embodiments of a first heat-not-burn smoking article.

FIG. 1 (*i*) illustrates an embodiment of the first smoking article. In the figure, 100 is a smoking article, 1 is a tobacco rod, 3 is a cooling segment, 5 is a filter segment, 7 is a tipping paper, and 1*b* is an increased adhesive portion. In this embodiment, the cooling segment 3 corresponds to the low-stiffness member L and the filter segment 5 corresponds to the high-stiffness member H. Specific examples of such a combination of the member L and the member H include a combination of a cooling segment that includes a polymer sheet, such as polylactic acid, and a filter segment filled with cellulose acetate fibers. The polymer sheet may be gathered or crimped. In this embodiment, the tobacco rod 1 and the cooling segment 3 may be wrapped in a tipping paper in a different manner.

FIG. 1 (*ii*) illustrates another embodiment of the first smoking article. In this embodiment, the tobacco rod 1 corresponds to the member H and the cooling segment 3 corresponds to the member L. Specific examples of such a combination of the member H and the member L include a combination of a tobacco rod highly filled with tobacco raw materials, such as tobacco shreds, and a cooling segment that includes a polymer sheet, such as polylactic acid. The polymer sheet may be gathered.

The member L preferably has a diameter larger than the member H. As a result, deformation of the member L can be suppressed. The member L preferably has a diameter 0.05 to 0.15 mm larger than the member H. Moreover, the member L has a diameter preferably 0.5 to 2.5% larger and more preferably 1.0 to 2.0% larger than the member H. The member L and the member H may be selected from a tobacco rod, a cooling segment, a filter segment, and other members. However, at least either of the member L and the member 14 is preferably selected from a tobacco rod, a cooling segment, and a filter segment.

(1) Tobacco Rod

A tobacco rod is an almost cylindrical member for generating smoking flavor components contained in tobacco raw materials and includes tobacco filler and a paper wrapper wrapped therearound, The tobacco filler is not limited, and tobacco shreds or tobacco sheets, for example, may be used therefor. Specifically, tobacco shreds prepared by cutting dry tobacco leaves into a width of 0.8 to 1.2 mm may be packed inside a paper wrapper. Alternatively, those prepared by uniformly pulverizing dry tobacco leaves into an average particle size of about 20 to 200 μm, forming into sheets, and cutting the sheets into a width of 0.8 to 1.2 mm may be packed inside a paper wrapper. Moreover, such sheets may be gathered, folded, or spirally rolled without cutting and packed inside a paper wrapper. Further, such sheets may be cut into strips and packed inside a paper wrapper concentrically or with the longitudinal direction of the strips aligned parallel to the longitudinal direction of a tobacco rod.

The tobacco rod may generate an aerosol upon heating. To promote the generation of an aerosol, it is preferable to add an aerosol source, such as glycerol, propylene glycol, 1,3-butanediol, or other polyols, to the tobacco tiller. The amount of an aerosol source to be added is preferably 5 to 50 weight % and more preferably 10 to 30 weight % based on the dry weight of the tobacco tiller. In addition, the tobacco rod may contain a flavor, such as menthol. The length of the tobacco rod is not limited but is preferably 15 to 25 mm. The diameter is also not limited but is preferably 6.5 to 7.5 mm. Meanwhile, when a neighboring member has stiffness higher than the tobacco rod, the tobacco rod preferably has a diameter larger than the neighboring member. As a result, deformation of the tobacco rod can be suppressed. Accordingly, in this case, the tobacco rod has a diameter preferably 0.5 to 2.5% larger and more preferably 1.0 to 2.0% larger than the neighboring member. In actual dimension, the tobacco rod preferably has a diameter about 0.05 to 0.15 mm larger than the neighboring member.

Figure 7:
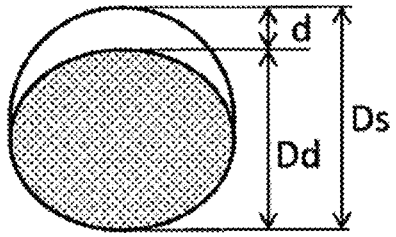
FIG. 7 is a view for illustrating a measurement method for stiffness.

The term "stiffness" in the present invention means the resistance member to deformation as disclosed in paragraphs to of Japanese Unexamined Patent Application Publication (Translation of PCT Application) No. 2016-523565. Stiffness can be obtained, for example, from a change in diameter before and after applying a load F on the side surface of a tobacco rod. When the diameter of a tobacco rod before applying a load F is denoted by Ds and the diameter after applying the load is denoted by Dd as in FIG. 7, the amount depressed is d=Ds−Dd and the stiffness is defined by the following formula. The same applies to other members.

$$\text{Stiffness}(\%)=Dd/Ds\times 100$$

(2) Cooling Segment

A cooling segment is a member for cooling an aerosol and smoking flavor components generated in the tobacco rod 1. The cooling segment 3 may be a hollow paper tube. The paper tube is preferably made of cardboard having stiffness higher than paper wrappers and tipping papers. The paper tube may be provided with a hole (ventilation holes). A plurality of holes are preferably formed along the circumference of the paper tube. In view of efficient operations, such holes are preferably formed by laser processing of a finished smoking article. Moreover, to enhance heat exchange efficiency, gathered sheets may be packed inside the cooling segment 3. Such sheets may be polymer sheets, such as polylactic acid. Although the dimensions of the cooling segment 3 are not limited, the length is preferably 15 to 25 rum and the diameter is preferably 5.5 to 7.5 mm. Meanwhile, when a member neighboring the cooling segment 3 has stiffness lower than the cooling segment 3, the cooling segment 3 has a diameter preferably 0.5 to 2.5% smaller and preferably 1.0 to 2.0% smaller than the neighboring member. When the cooling segment 3 includes a paper tube made of cardboard, the segment generally has stiffness higher than the tobacco rod 1. Meanwhile, as in the foregoing, when the cooling segment 3 is made of a polymer sheet or the like, such as polylactic acid, and wrapped in a common wrapper, the segment could have stiffness lower than the tobacco rod 1.

(3) Filter Segment

A filter segment is a member including a filter. As the filter, a publicly known filter member, such as an acetate filter or a paper filter, may be used. A paper filter is a paper-filled filter prepared by creasing paper through processing with a crepe roller or the like and by rolling the paper using a plug wrapper. An acetate filter is a filter filled with cellulose acetate fibers. The filter segment 5 is preferably composed of a plurality of members and more preferably includes a filter 51 and a center hole member 53 (FIG. 1 (*iii*)). An acetate filter having a space provided in the center part may be used as the center hole member, fir example. The length of the filter segment 5 is not limited but is preferably 10 to 20 mm. When both a center hole memner and an acetate filter are arranged as a filter segment the order is not limited. Moreover, individual members may be wrapped in each filter inner wrapper and joined with a filter outer wrapper. The diameter of the filter segment is not limited but is preferably almost the same as those of other segments excluding a tobacco rod. As a result, tearing and creasing of a tipping paper can be suppressed.

(4) Tipping Paper

The term "tipping paper" refers to a paper used for joining two or more members, such as a tobacco rod, a cooling segment, and a filter segment. Meanwhile, the term "paper wrapper" refers to a paper for wrapping individual members that constitute a tobacco rod, a cooling segment, or a filter segment. For example, when a filter segment includes a center hole member and an acetate filter as in the foregoing, a paper for wrapping the center hole member and a paper for wrapping the acetate filter are each paper wrapper.

Exemplary base paper for tipping papers and paper wrappers includes, but is not limited to, paper using cellulose fibers. Such cellulose fibers may be either derived from plants or chemically synthesized, or may be a mixture thereof. Exemplary plant-derived fibers include pulp of flax fibers, wood fibers, or seed fibers, for example. Such pulp may be colored unbleached pulp. However, from a viewpoint of obtaining white clean appearance, it is preferable to use bleached pulp, which is prepared using a bleaching agent, such as an oxidant or a reductant.

For a typical paper wrapper for cigarettes, a citric acid alkali metal salt or the like is used as a common burning chemical (combustion aid, for example) that can affect the spontaneous combustion rate of the paper wrapper. In the present invention, a heat-not-burn smoking article but not a combustion-type is preferable. In this case, since the combustion of a paper wrapper is unnecessary, the paper wrapper need not contain a burning chemical.

The lower limit of the basis weight of a paper wrapper is preferably 30 $g/m^2$ or more, more preferably 35 $g/m^2$ or more, and further preferably 40 $g/m^2$ or more. The upper limit is preferably 65 $g/m^2$ or less and more preferably 50 $g/m^2$ or less. Meanwhile, the lower limit of the basis weight of a tipping paper is preferably 20 $g/m^2$ or more, more preferably 25 $g/m^2$ or more, and further preferably 30 $g/m^2$ or more. The upper limit is preferably 50 $g/m^2$ or less, more preferably 45 $g/m^2$ or less, and further preferably 40 $g/m^2$ or less. The basis weight can be measured by the method specified in JIS P 8124.

(5) Other Members

The smoking article of the present invention may include a member excluding the above-described members. Exemplary other members include a support segment. A support segment is a member that enhances the strength of the smoking article or a member that is disposed in the downstream side of a tobacco rod and that suppresses displacement of tobacco filler. Such a support segment may be the foregoing center hole member, for example. When a center hole member is used as a support segment, the dimensions are not limited but the length is preferably 5 to 10 mm and the diameter is preferably 5 to 8 mm.

2. First Manufacturing Method.

Figure 2:
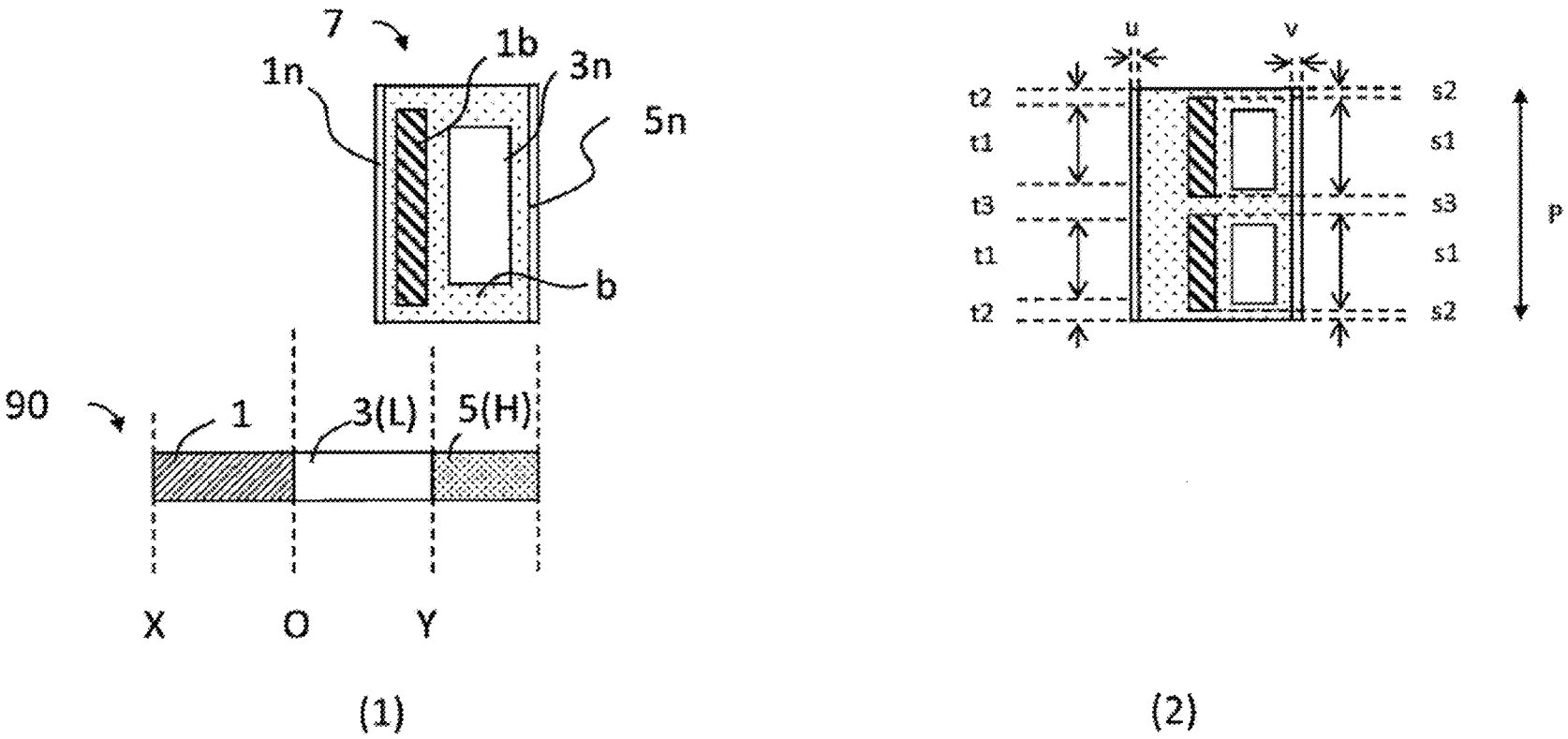
FIG. 2 illustrates embodiments of a tipping paper.
Figure 3:
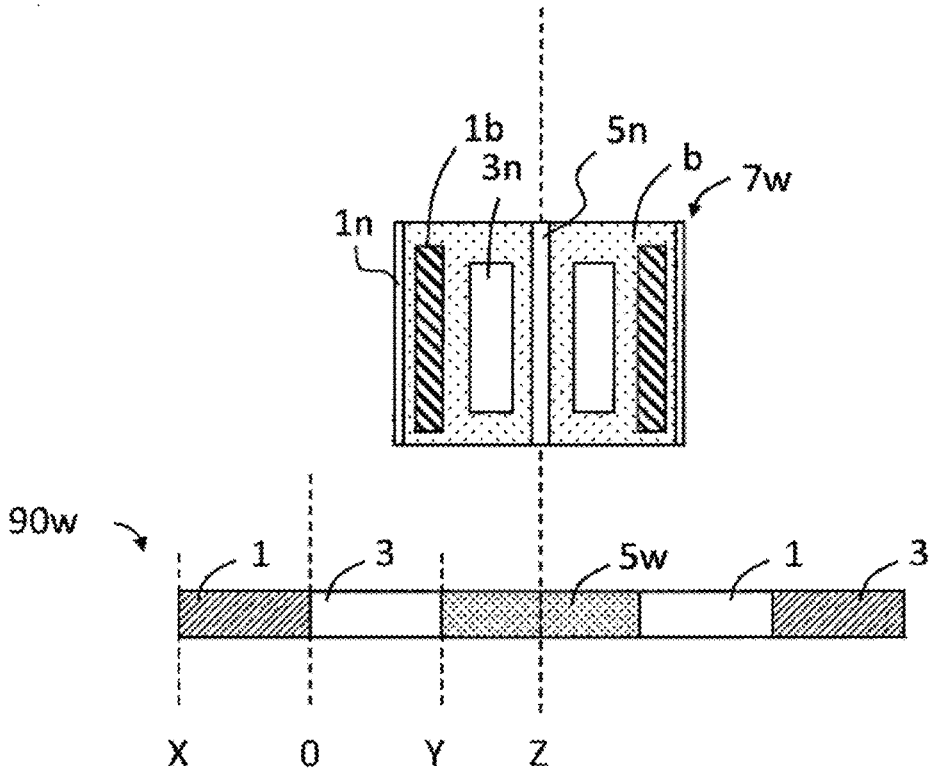
FIG. 3 illustrates another embodiment of the tipping paper.

FIG. 2 illustrates the outline of the first manufacturing method. In the figure, 90 is a smoking article before wrapping, in other words, a composite segment, 0 is the contact part between the tobacco rod 1 and the cooling segment 3, Y is the contact part between the cooling segment 3 (member L) and the filter segment 5 (member H), 7 is a tipping paper for wrapping the composite segment 90, b is a portion of a low adhesive weight per unit area after solidification (hereinafter, also simply referred to as "adhesive portion"), 1*b* is a portion of a high adhesive weight per unit area after solidification (hereinafter, also simply referred to as "increased adhesive portion"), In is a non-adhesive portion in the leading end region of the tipping paper 7, 3*n* is a non-adhesive portion in a region for wrapping the filter segment, and P is the length in the circumferential direction of the tipping paper 7. FIG. 2 (2) illustrates an embodiment in which a plurality of increased adhesive portions 1*b* and so forth exist, where s1, s2, t1, t2, u, and v denote the respective dimensions. The leading end region of the tipping paper 7 in this embodiment indicates a tipping paper region positioned at the end in the direction opposite to the mouth end. FIG. 3 illustrates an embodiment in which a double-length composite segment 90*w*, which has a double length of the composite segment 90, is wrapped. In the figure, 7*w* is a double-length tipping paper for wrapping the double-length composite segment 90*w*, Z is a longitudinal central part in a double-length filter segment 5*w*, and other signs are the same as in FIG. 2. In FIGS. 2 and 3, the vertical direction in the tipping paper is referred to as the circumferential direction and the horizontal direction as the longitudinal direction, for convenience. Hereinafter, with reference to FIG. 2, the manufacturing method of the present invention will be described.

(1) Step A

In this step, an adhesive is placed on either surface of the tipping paper 7. A method of placing an adhesive is not limited, and a method of applying an adhesive to the tipping paper 7 or a method of preparing an adhesive sheet in advance and disposing the adhesive sheet on the tipping paper 7, for example, may be employed. Specific examples include a method of applying an adhesive to a roller surface and transferring the adhesive to the tipping paper 7 and a method of discharging an adhesive from nozzles onto the tipping paper 7.

Figure 4:
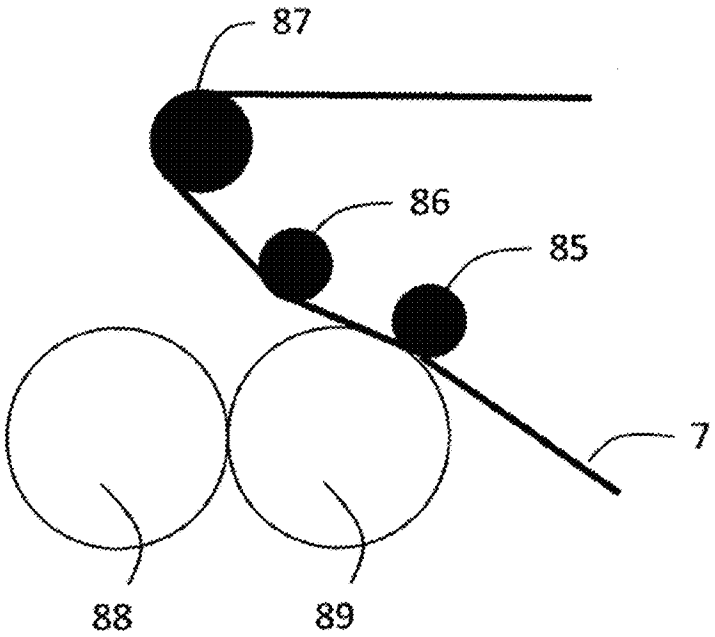
FIG. 4 illustrates a step of placing an adhesive by rollers.
Figure 4:
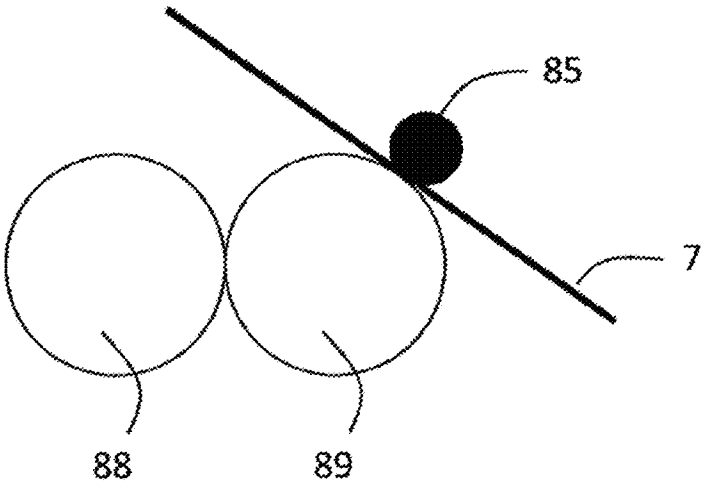
Figure 5:
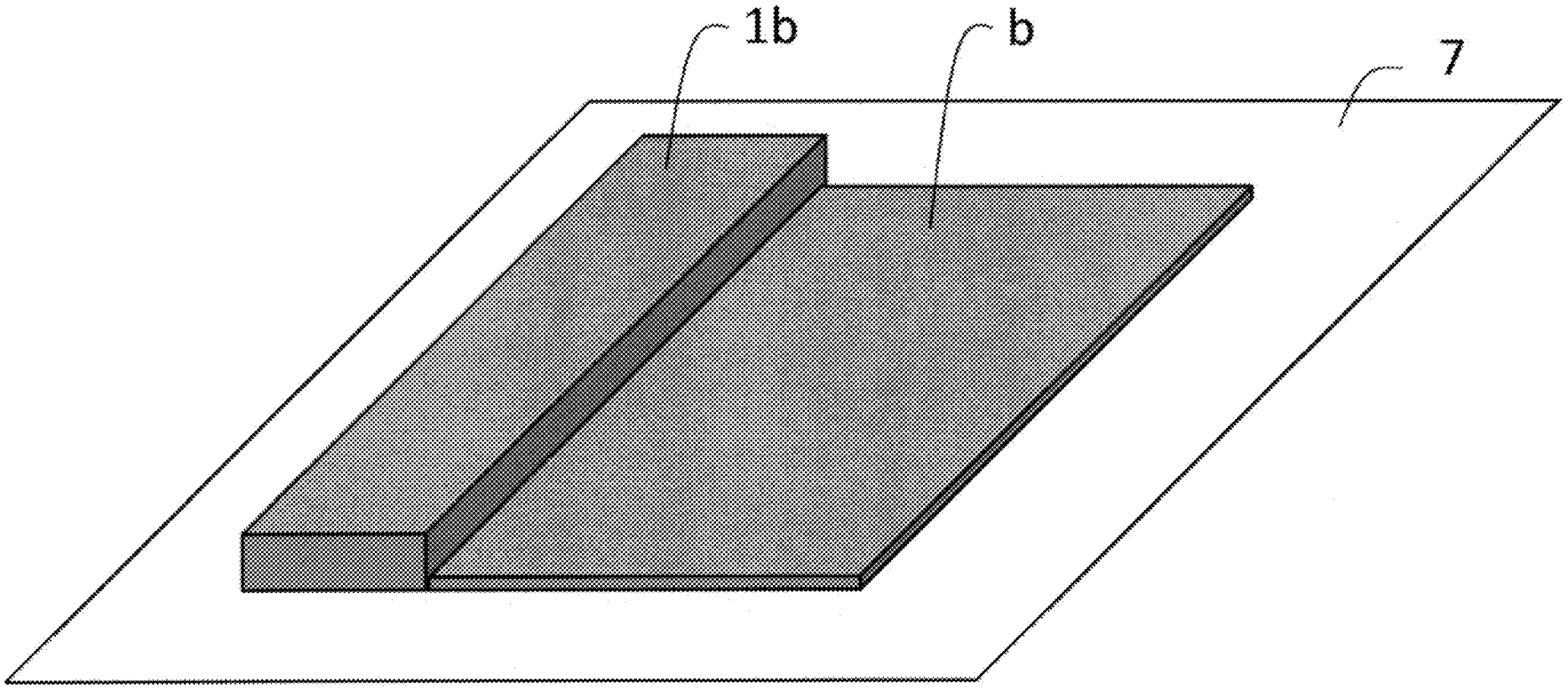
FIG. 5 schematically illustrates a tipping paper on which an adhesive has been placed by rollers.

FIG. 4 illustrates an example of the method of applying an adhesive to a roller surface and transferring the adhesive to the tipping paper 7, where 88 is a pattern roller having a depression provided on the surface for holding an adhesive as a desirable pattern, 89 is a transfer roller for transferring the adhesive held by the pattern roller 88, and 85 is a counter roller. An adhesive is transferred from the depression of the pattern roller 88 to the transfer roller 89 and is further transferred from the transfer roller 89 to the tipping paper 7. On this occasion, the amount of the adhesive to be applied (amount to be transferred) is stabilized by providing the counter roller 85. Moreover, as illustrated in FIG. 4 (2), the amount to be applied is further stabilized by providing a reversing roller 87. Meanwhile, when the amount of an adhesive is large, the tipping paper 7 is not readily released from the transfer roller 89, thereby varying the release position therefrom. However, by providing a second counter roller 86, the release position can be stabilized since an appropriate tension is applied to the tipping paper 7. FIG. 5 is an example of the tipping paper 7 on which an adhesive has been placed by such a method. Although a clear step is observed in the boundary portion between the increased adhesive portion 1*b* and the adhesive portion b in FIG. 5, a gradual slope, in place of such a step, may be formed from the increased adhesive portion 1*b* to the adhesive portion b.

Figure 6:
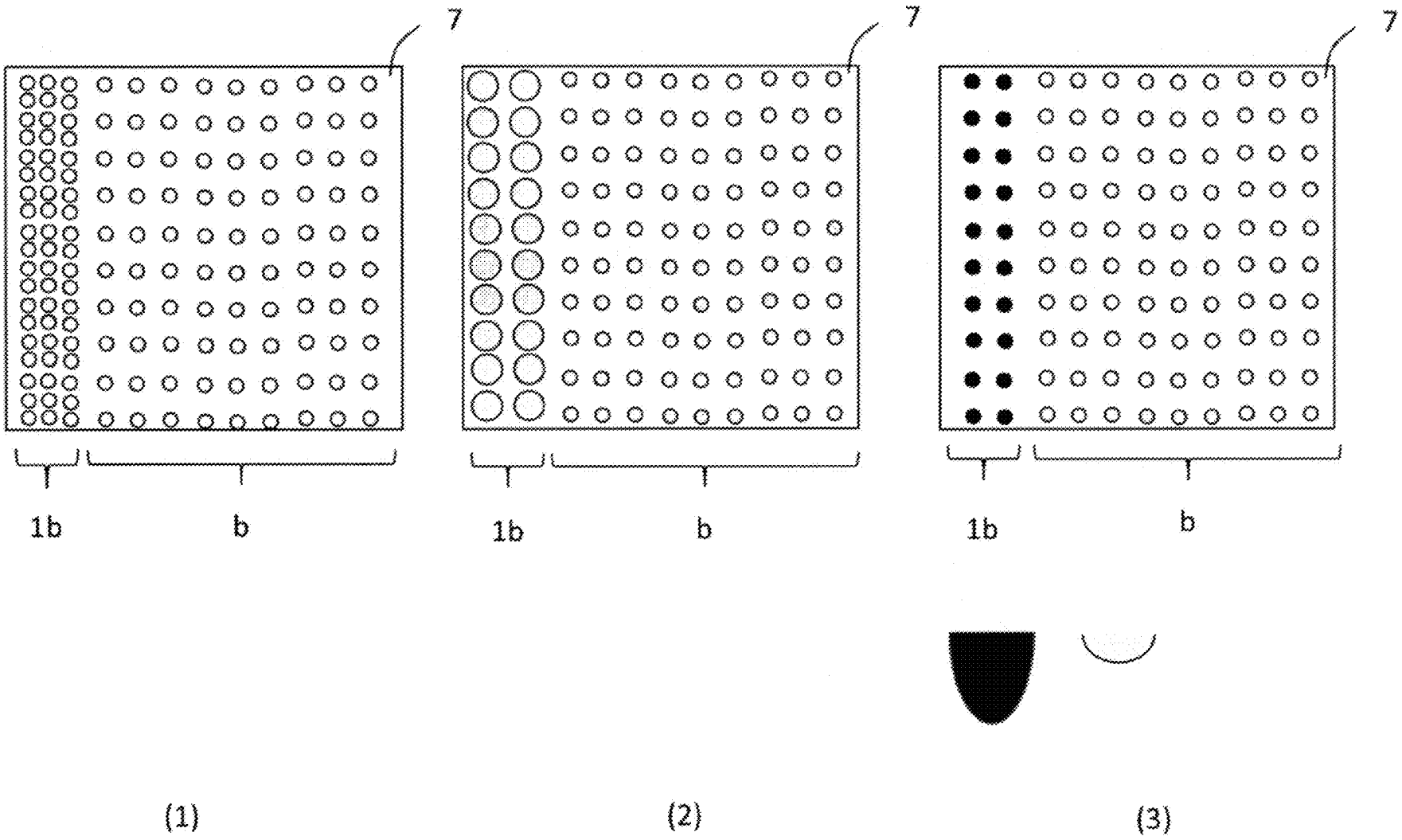
FIG. 6 schematically illustrates tipping papers on which an adhesive has been placed through nozzle discharge.

FIG. 6 illustrates examples of the tipping paper 7 having adhesive dots obtained by the method of discharging an adhesive from nozzles onto the tipping paper 7. For example, as in FIG. 6 (1), the increased adhesive portion 1*b* can be formed by increasing the density of adhesive dots. Moreover, as in FIG. 6 (2), the increased adhesive portion 1*b* can be formed by increasing the diameter of adhesive dots. The diameter of adhesive dots is the diameter of circles formed by the dots on the surface of the tipping paper 7, Alternatively, as in FIG. 6 (3), the increased adhesive portion 1*b* can also be formed by increasing the height of adhesive dots (see the figure below FIG. 6 (3)). The increased adhesive portion 1*b* may be formed by combining these methods.

As the adhesive, publicly known adhesives may be used but vinyl acetate-based adhesives are particularly preferable. The expression "after solidification" indicates a solidified state after removal of solvent in the case of a solvent-containing adhesive and a, crosslinked state in the case of a solvent-free crosslinkable adhesive. Moreover, the "adhesive weight per unit area after solidification" is also simply referred to as "adhesive weight."

The adhesive portion b indicates a portion that has an adhesive and that excludes the increased adhesive portion 1*b*. An adhesive weight in the adhesive portion b can be adjusted appropriately but is preferably 0.005 to 0.015 mg/mm$^2$. The adhesive layer thickness in the adhesive portion b is preferably set to about 0.01 to 0.03 mm in the unsolidified state. The unsolidified state means a state before solidification of the adhesive. In the present invention, the adhesive weight in the increased adhesive portion 1*b* is set larger than the adhesive weight in the adhesive portion b. In general, the adhesive strength increases as the adhesive weight increases. Consequently, however, creases tend to be formed in products. In the present invention, since the adhesive weight is increased only in the increased adhesive portion 1*b*, it is possible to prevent slipping off of the member L and prevent crease formation in the remaining portion. In this view, the ratio of the adhesive weight in the increased adhesive portion 1*b* (1b weight) to the adhesive weight in the adhesive portion b (b weight) is preferably 1.5 to 3.0 and more preferably 1.7 to 2.7. The "1*b* weight" is an average adhesive weight in the increased adhesive portion 1*b*. When a plurality of portions having different adhesive weights exist, the "1*b* weight" is defined as an average adhesive weight in a portion having the maximum adhesive weight and the "b weight" as an average adhesive weight in the adhesive portion b excluding the increased adhesive portion 1*b*.

As the area of the increased adhesive portion 1*b* increases, failures, such as slipping off of a member, becomes less likely to arise. However, in view of costs or the like, the increased adhesive portion 1*b* need not be placed on the entire surface of the member L, The increased adhesive portion 1*b* preferably exists in a region extending from a bonding face between the member L and the member H in FIG. 2 (1)) to a 20 to 40% position of the cooling segment 3 in the longitudinal direction. In other words, the increased adhesive portion 1*b* preferably exists in a region from the point Y to 0.2Y to 0.4Y in FIG. 2. As illustrated in FIG. 2, two or one increased adhesive portion 1*b* may exist in the circumferential direction. The total length (s1+s1 in FIG. 2 (2)) of the increased adhesive portions 1*b* in the circumferential direction is preferably 70 to 90% of the length P in the circumferential direction of the tipping paper 7. When two increased adhesive portions 1*b* exist in the circumferential direction, the distance s2 from the circumferential direction end to each increased adhesive portion 1*b* is preferably 2 to 5% of P. The gap s3 between the increased adhesive portions 1*b* is appropriately adjusted by s1 and s2.

The tipping paper 7 preferably has a non-adhesive portion 1*n* at the leading end. The leading end indicates a tipping paper region positioned at the end on the side opposite to the mouth end when the tipping paper is wrapped around. As a result, bleeding of an adhesive from the leading end of the tipping paper 7 is prevented during wrapping. The length u of the non-adhesive portion 1*n* in the longitudinal direction of the tipping paper 7 is preferably 0.1 to 1.0 mm.

The tipping paper 7 preferably has a non-adhesive portion 3*n* in a region for wrapping the cooling segment 3 or the filter segment 5. When the non-adhesive portion 3*n* is provided, ventilation holes are easily formed in these segments of a smoking article 100 to be manufactured. Such ventilation holes can be formed, for example, by laser processing after manufacturing a smoking article 100. Moreover, printing may also be performed in the non-adhesive portion 3*n*. For example, when a code that represents the manufacturing machine is printed on the non-adhesive portion 3*n*, the code can be read after wrapping by peeling off the tipping paper 7.

The non-adhesive portion 3*n* may be provided in a region extending from a 40 to 50% position to a 70 to 90% position in the longitudinal direction of the filter segment 5 based on the contact face (point Y) between the cooling segment 3 and the filter segment 5. In other words, the non-adhesive portion 3*n* may be provided in a region from 0.4 to 0.5Y to to 0.9Y in the mouth end direction of FIG. 2. By providing the non-adhesive portion 3*n* like this, it is possible to suppress lowering in adhesive force of the tipping paper as a whole.

As illustrated in FIG. 2, two or one non-adhesive portion 3*n* may exist in the circumferential direction. The total length (t1+t1 in FIG. 2 (2)) of the non-adhesive portions 3*n* in the circumferential direction is preferably 50 to 80% of the length P in the circumferential direction of the tipping paper 7. When two non-adhesive portions 3*n* exist in the circumferential direction, the distance t2 from the circumferential direction end to each non-adhesive portion 3*n* is preferably 5 to 10% of P. The gap t3 between the non-adhesive portions 3*n* is appropriately adjusted by t1 and t2.

The tipping paper 7 preferably has a non-adhesive portion 5*n* near the filter segment end. As illustrated in FIG. 3, a smoking article 100 is manufactured in some cases by preparing and cutting a double-length smoking article 100*w*. On this occasion, it is possible to facilitate cutting and prevent soiling of a cutter with an adhesive. The length v of the non-adhesive portion 5*n* in the longitudinal direction of the tipping paper 7 is preferably 0.5 to 1.0 mm. The longitudinal length of the tipping paper 7 may be a length in the range from the mouth end of the filter segment 5 to a 0.42× to 0.6× of the tobacco rod 1 in the longitudinal direction.

(2) Step B

In this step, the composite segment 90 is wrapped in the tipping paper 7. As illustrated in FIG. 3, the double-length composite segment 90*w* may be wrapped in the tipping paper 7*w*. In this case, smoking articles 100 are obtained by cutting after wrapping.

Figure 8:
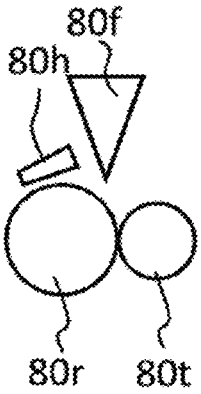
FIG. 8 illustrates an embodiment of an apparatus for performing step B.
Figure 9:
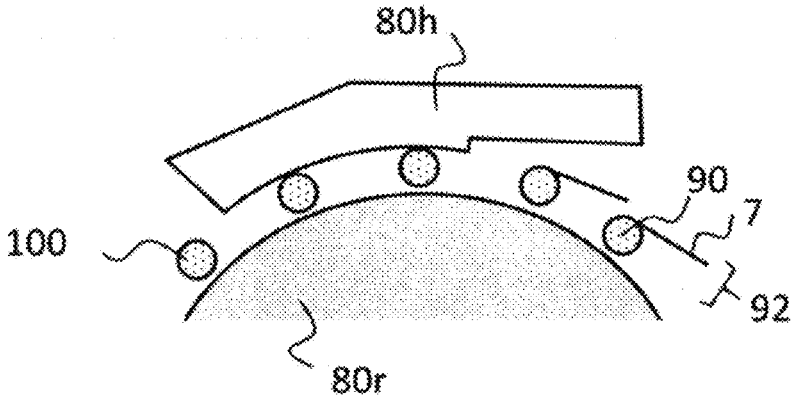
FIG. 9 illustrates an embodiment of step B.

Wrapping can be performed by a publicly known method. As illustrated in FIG. 8, for example, this step can be performed using an apparatus equipped with a plurality of drums. In the figure, 80*f* is a feeder for a tipping paper 7, 80*t* is a conveyor drum, 80*r* is a rolling drum, and 80*h* is a rolling hand. A rolling drum is a drum having a holding section that is for holding a member on the circumferential surface and that enables a segment or another member to rotate on its central axis in the longitudinal direction. A rolling hand is a means that is disposed facing the circumferential surface of the rolling drum and that is for forming a gap of a constant distance from the circumferential surface. A segment consisting of the tobacco rod 1, the cooling segment 3, and the filter segment 5 is referred to as a composite segment 90, The composite segment 90 is passed from the conveyor drum 80*t* to the rolling drum 80*r*. Meanwhile, part of a tipping paper 7 fed from the feeder 80*f* is attached to the circumferential surface of the segment on the rolling drum 80*r*, thereby forming a precursor 92 (see FIG. 9). The precursor 92 includes the tipping paper 7 attached, like a flag, to the composite segment 90. In other words, part of the tipping paper 7 is attached to the circumferential surface of the composite segment 90 while leaving the remainder free. The precursor 92 is fixed to the holding section on the circumferential surface of the rolling drum 80*r* through suction or the like and conveyed to the gap formed between the rolling drum 80*r* the rolling hand 80*h*, While passing through this gap, the entire circumferential surface of the precursor 92 is wrapped in the tipping paper 7 to form a smoking article 100 (see FIG. 9).

Figure 10:
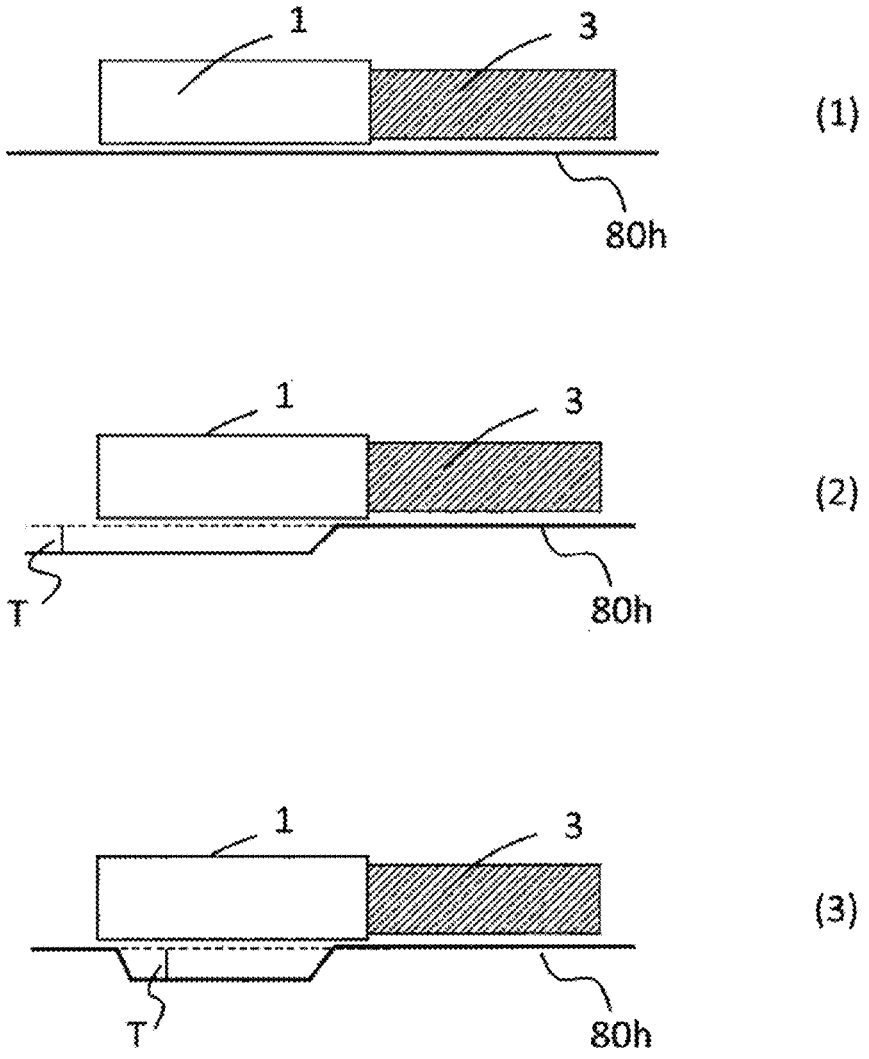
FIG. 10 illustrates embodiments of step B.

As in the foregoing, neighboring members have different diameters in some cases. For example, FIG. 10 illustrates a combination of the tobacco rod 1 as a larger-diameter member and the cooling segment 3 as the neighboring member. In this case, if the surfaces of the rolling drum 80*r* and the rolling hand 80*h* are flat, excessive contact arises between these surfaces and the larger-diameter member (FIG. 10 (1)). This results in failures under the impact on the larger-diameter member. For example, when the larger-diameter member is a tobacco rod, a problem of falling fillings from the leading end arises. In addition, the difference in circumference causes twisting, thereby developing defects, such as creases, in a product. For these reasons, it is preferable in the present invention to form a gap from the larger-diameter member by providing a depression on the rolling drum 80*r* or rolling hand 80*h* surface that faces the larger-diameter member as illustrated in FIGS. 10 (2) and (3). Although FIG. 10 (2) and (3) illustrate embodiments in which a depression is provided on the rolling hand 80*h*, a depression may be provided on the rolling drum 80*r* or both the rolling drum and the rolling hand. The depth of the depression (T FIGS. 10 (2) and (3)) is appropriately adjusted and is preferably 0.05 to 0.15 mm. Such a depression need not be provided on the entire surface that faces the tobacco rod 1. As illustrated in FIG. 10, a depression may be provided on part of the surface that faces the tobacco rod 1. Meanwhile, to reliably attach a tobacco rod to another member by using a tipping paper, a depression is preferably absent near the boundary between these two members.

II. Second Method

1. Second Heat-not-Burn Smoking Article

Figure 12:
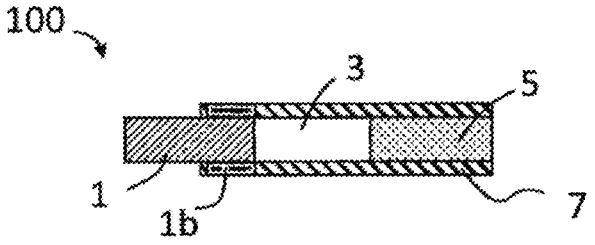
FIG. 12 illustrates an embodiment of a second heat-not-burn smoking article.

A second heat-not-burn smoking article of the present invention (hereinafter, also simply referred to as "second smoking article" includes, as members, at least a tobacco rod, a cooling segment, and a filter segment. FIG. 12 illustrates an embodiment of the second smoking article. In the figure, 100 is a smoking article, 1 is a tobacco rod, 3 is a cooling segment, 5 is a filter segment, 7 is a tipping paper, and 1*b* is a tipping paper portion of a high adhesive weight per unit area after solidification. Regardless of the stiffness value of the tobacco rod 1 relative to the stiffness of its neighboring member, the second smoking article includes the portion of a high adhesive weight 1*b* in a region of the tipping paper 7 for wrapping the tobacco rod 1. As a result, it is possible to reliably suppress slipping off of the tobacco rod 1. In other words, the second smoking article encompasses embodiments of G<g, G=g, and G>g where G is the stiffness of a tobacco rod and g is the stiffness of its neighboring member.

A member neighboring a tobacco rod is not limited. Exemplary combinations of a tobacco rod and its neighboring member include the following sequences.

Tobacco rod/cooling segment

Tobacco rod/support segment

The tobacco rod, the cooling segment, the filter segment, the support segment, and the tipping paper are as described for the first smoking article.

2. Second Manufacturing Method

The second manufacturing method includes (A') placing an adhesive on either surface of a tipping paper to form each portion of a high adhesive weight and a low adhesive weight per unit area after solidification, where the portion of a high adhesive weight is provided in a region for wrapping the tobacco rod; and (B) preparing a composite segment that contains at least the tobacco rod, the cooling segment, and the filter segment and wrapping the composite segment in the tipping paper.

Figure 13:
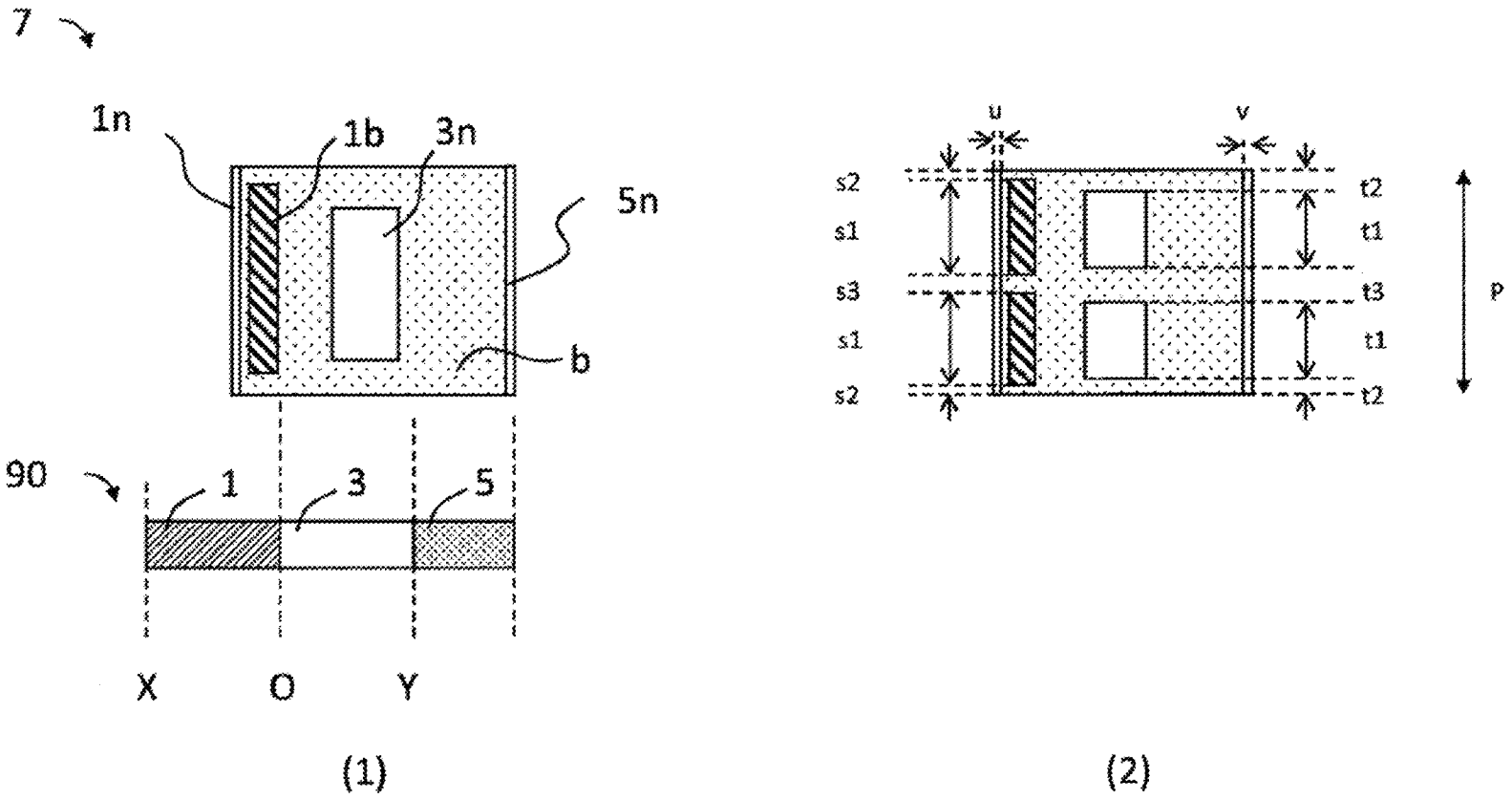
FIG. 13 illustrates embodiments of a tipping paper.

FIG. 13 illustrates the outline of the second manufacturing method. In the figure, 90 is a smoking article before wrapping, in other words, a composite segment, O is the contact part between the tobacco rod 1 and the cooling segment 3 as the neighboring member, Y is the contact part between the cooling segment 3 and the filter segment 5, 7 is a tipping paper for wrapping the composite segment 90, and other signs are as in the foregoing.

(1) Step A'

In this step, an adhesive is placed on either surface of the tipping paper 7. The method of placing an adhesive can be performed in the same manner as the first method as illustrated in FIGS. 4 to 6. The adhesive weight and so forth of the adhesive portion b are also as described for the first manufacturing method. In the present invention, since the adhesive weight only in the increased adhesive portion 1*b* is increased, it is possible to prevent slipping off of the tobacco rod 1 and prevent crease formation in the remaining portion. As the area of the increased adhesive portion 1*b* increases, failures, such as slipping off of the tobacco rod, becomes less likely to arise. However, in view of costs or the like, the increased adhesive portion 1*b* need not be placed on the entire surface of the tobacco rod 1. The increased adhesive portion 1*b* preferably exists in a region extending from a bonding face between the tobacco rod 1 and the neighboring member (O in FIG. 13 (1)) to a. 20 to 40% position of the tobacco rod 1 in the longitudinal direction. In other words, the increased adhesive portion 1*b* preferably exists in a region from the point O to to 0.4× in FIG. 13. As illustrated FIG. 13, two or one increased adhesive portion 1*b* may exist in the circumferential direction. The total length (s1+s1) of the increased adhesive portions 1*b* in the circumferential direction is preferably 70 to 90% of the length P in the circumferential direction of the tipping paper 7. When two increased adhesive portions 1*b* exist in the circumferential direction, the distance s2 from the circumferential direction end to each increased adhesive portion 1*b* is preferably 2 to 5% of P. The gap s3 between the increased adhesive portions 1*b* is appropriately adjusted by s1 and s2.

The increased adhesive portion 1*b* is preferably not wrapped around the cooling segment 3. When the cooling segment 3 having low stiffness is wrapped in the increased adhesive portion 1*b*, creases tend to be formed. Moreover, when the cooling segment 3 is a paper tube made of cardboard, an adhesive is less likely to permeate the cardboard, due to the high basis weight, compared with a paper wrapper for the tobacco rod 1. For these reasons, when the amount of an adhesive is smaller in a region for wrapping the paper tube than in a region for wrapping the tobacco rod 1, it is possible to suppress failures, such as bleeding of an adhesive, crease formation, and failed bonding.

The tipping paper 7 preferably has a non-adhesive portion in at the leading end.

The leading end in this embodiment indicates a tipping paper region positioned at the end on the tobacco rod side when the tipping paper is wrapped around. As a result, bleeding of an adhesive from the leading end of the tipping paper 7 is prevented during wrapping. The length u of the non-adhesive portion 1*n* in the longitudinal direction of the tipping paper 7 is preferably 0.1 to 1.0 mm. The non-adhesive portions 3*n* and 5*n* are as described for the first manufacturing method.

(2) Step B'

Figure 14:
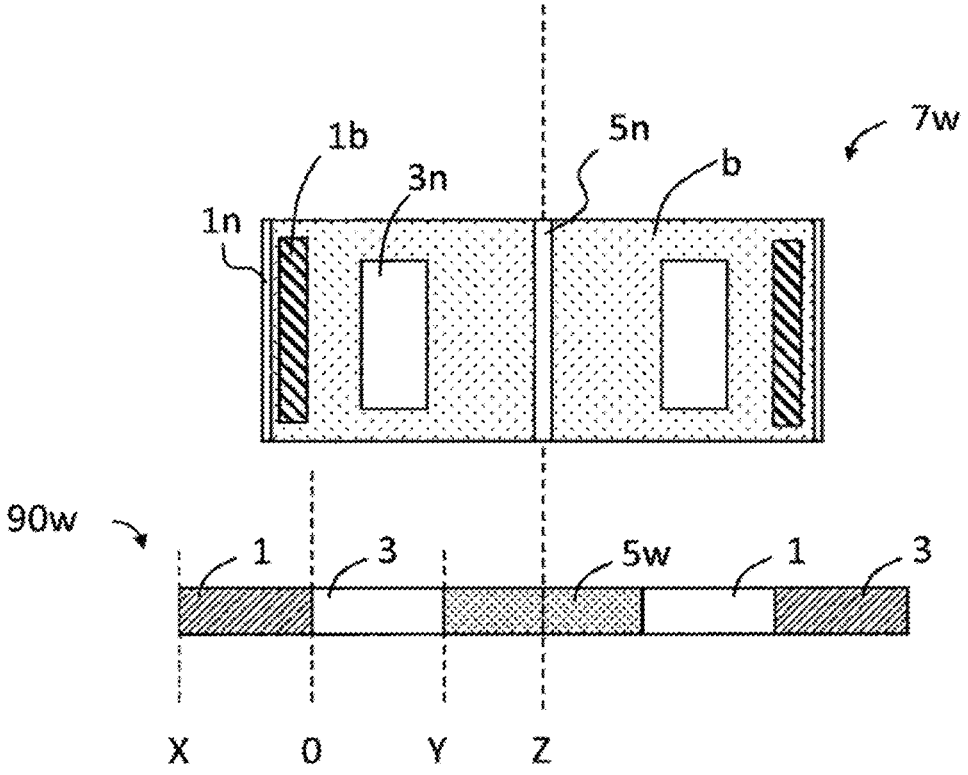
FIG. 14 illustrates another embodiment of the tipping paper.

In this step, as described for the first manufacturing method, the composite segment 90 is wrapped in the tipping paper 7. As illustrated in FIG. 14, the double-length composite segment 90*w* may be wrapped in the tipping paper 7*w*. In this case, smoking articles 100 are obtained by cutting after wrapping.

As in the foregoing, the tobacco rod 1 has a diameter larger than the neighboring member (cooling segment 3, for example) in some cases. In this case, as described for the first manufacturing method with reference to FIG. 10, it is preferable to form a gap from the tobacco rod 1 by providing a depression on the rolling drum 80*r* or rolling hand 80*h* surface that faces the tobacco rod 1.

EXAMPLES

Example 1

The following members were prepared.

Tobacco rod of 7.0 mm in diameter and 20.0 mm in length (from Japan Tobacco Inc.)

Paper tube of 6.9 mm in diameter and 20.0 mm in length as a cooling segment

Double-length filter segment of 6.9 mm in diameter consisting of a center hole member (8.0 mm)/a double-length acetate filter (14.0 mm)/a center hole member (8.0 mm)

Figure 11:
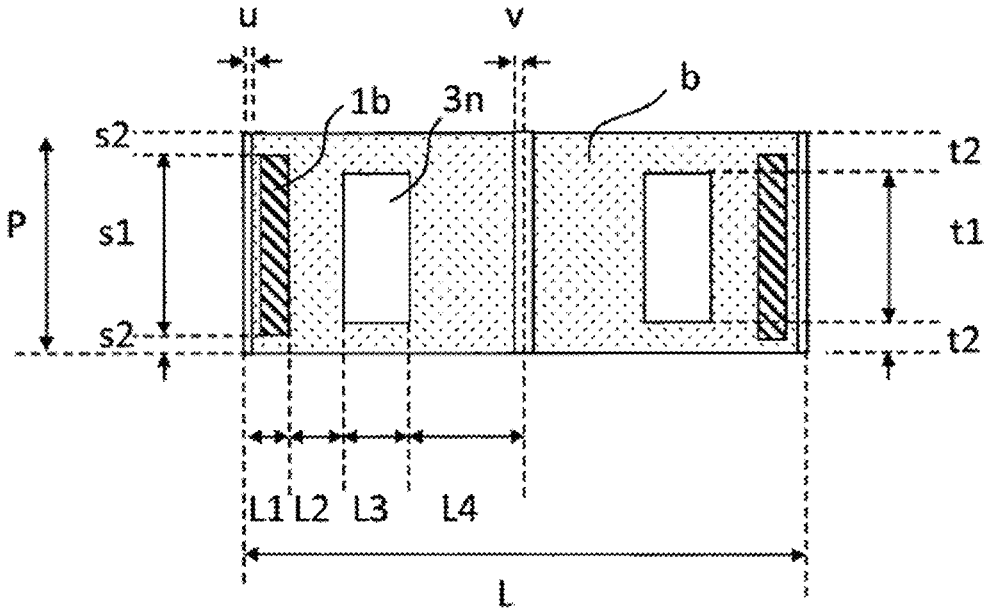
FIG. 11 illustrates the working example.

A tipping paper illustrated in FIG. 11 was prepared. The respective dimensions are shown in Table 1. An adhesive was applied to the tipping paper. The adhesive layer thickness in the unsolidified state and the adhesive weight after solidification are also shown in Table 1.

TABLE 1

| Length/thickness | Unit | Value |
|---|---|---|
| P | mm | 24.0 |
| s1 | | 21.3 |
| s2 | | 1.35 |
| t1 | | 18.0 |
| t2 | | 3.0 |
| L | | 80.0 |
| L1 | | 4.5 |
| L2 | | 11.5 |
| L3 | | 7.0 |
| L4 | | 17.0 |
| u | | 0.50 |
| v | | 0.75 |
| Adhesive layer thickness for b | | 0.02 |
| Adhesive layer thickness for b1 | | 0.05 |
| Adhesive weight after solidification for b | $mg/mm^2$ | 0.01 |
| Adhesive weight after solidification for b1 | | 0.025 |

A double-length smoking article as illustrated in FIG. 14 was prepared by placing the above-described members. A smoking article was obtained through wrapping of the double-length smoking article in the tipping paper. The obtained smoking article exhibited satisfactory appearance without creases as well as satisfactory resistance to slipping off of the tobacco rod.

REFERENCE SIGNS LIST

1 Tobacco rod
3 Cooling segment
5 Filter segment
  51 Acetate filter
  53 Center hole member
7 Tipping paper
100 Smoking article
b Adhesive portion
1*b* Increased adhesive portion
1*n* Non-adhesive portion at leading end of tipping paper 7
3*n* Non-adhesive portion in region for wrapping cooling segment
P Length in circumferential direction of tipping paper 7
7*w* Double-length tipping paper
100*w* Double-length smoking article
X Leading end of tobacco rod 1
O Contact part between tobacco rod 1 and cooling segment 3
Y Contact part between cooling segment 3 and filter segment 5
Z Longitudinal central part in double-length filter segment 5*w*
80*f* Feeder for tipping paper 7
80*t* Conveyor drum
80*r* Rolling drum
80*h* Rolling hand
85 Counter roller
86 Second counter roller
87 Reversing roller
88 Pattern roller
89 Transfer roller
90 Composite segment
92 Precursor

The invention claimed is:

1. A method of manufacturing a smoking article that includes, as members, at least a tobacco rod, a cooling segment, and a filter segment and in which a low-stiffness member L and a high-stiffness member H having a greater stiffness than the low-stiffness member L are adjacent to each other, the method comprising (A) placing an adhesive on either surface of a tipping paper to form each portion of a first adhesive weight and a second adhesive weight per unit area after solidification, the first adhesive weight being greater than the second adhesive weight, wherein the portion of first adhesive weight is provided in a region for wrapping the member L; and (B) preparing a composite segment that includes at least the tobacco rod, the cooling segment, and the filter segment and wrapping the composite segment in the tipping paper, wherein in the step of A, the portion of the first adhesive weight is provided in a region extending from a contact face between the member L and the member H to a 20 to 40% position of the member L in the longitudinal direction.

2. The method according to claim 1, wherein the first adhesive weight is 1.5 to 3 times the second adhesive weight.

3. The method according to claim 1, wherein in a step of A, a non-adhesive portion is provided at the leading end of the tipping paper, which is defined as a tipping paper region positioned at the end on the side opposite to the mouth end when the tipping paper is wrapped around.

4. The method according to claim 1, wherein in a step of A, a non-adhesive portion is provided in a region of the tipping paper for wrapping the cooling segment or the filter segment.

5. The method according to claim 1, wherein the composite segment in a step of B is a pair of the composite segments placed such that filter segment end faces come into contact with each other.

6. The method according to claim 5, wherein a non-adhesive portion is provided near a region for wrapping a contact part between the filter segment end faces.

7. The method according to claim 4, further comprising providing a hole in the non-adhesive portion.

8. The method according to claim 4, further comprising performing printing in the non-adhesive portion.

9. The method according to claim 1, wherein the member L has a diameter larger than the member H.

10. The method according to claim 9, wherein the member L has a diameter to 0.15 mm larger than the member H.

11. The method according to claim 9, wherein the member L has a diameter to 2.5% larger than the member H.

12. A smoking article comprising, as members, at least a tobacco rod, a cooling segment in contact with the tobacco rod, a filter segment, and a tipping paper for wrapping the tobacco rod, the cooling segment, and the filter segment and comprising a low-stiffness member L adjacent to a high-stiffness member H, wherein the tipping paper has each portion of a first adhesive weight and a second adhesive weight per unit area after solidification, the first adhesive weight being greater than the second adhesive weight; and the tipping paper includes the portion of the first adhesive weight in a region for wrapping the member L, wherein the portion of the first adhesive weight is provided in a region extending from a contact face between the tobacco rod and a member immediately adjacent the tobacco rod to a 20 to 40% position of the tobacco rod in the longitudinal direction.

13. The smoking article according to claim 12, wherein the first adhesive weight is 1.5 to 3 times the second adhesive weight.

14. The smoking article according to claim 12, wherein the tipping paper has a non-adhesive portion in a region for wrapping the cooling segment.

15. The smoking article according to claim 12, wherein the tipping paper has a non-adhesive portion in a region for wrapping the filter segment.

16. The method according to claim 1, wherein the member L is the cooling segment.

17. The method according to claim 1, wherein the member H is the filter segment.

18. A method of manufacturing a smoking article that includes, as members, at least a tobacco rod, a cooling segment, and a filter segment, comprising (A') placing an adhesive on either surface of a tipping paper to form each portion of a first adhesive weight and a second adhesive weight per unit area after solidification, the first adhesive weight being greater than the second adhesive weight, wherein the portion of the first adhesive weight is provided in a region for wrapping the tobacco rod; and (B') preparing a composite segment that includes at least the tobacco rod, the cooling segment, and the filter segment and wrapping the composite segment in the tipping paper, wherein in the step of A', the portion of the first adhesive weight is provided in a region extending from a contact face between the tobacco rod and a member immediately adjacent the tobacco rod to a 20 to 40% position of the tobacco rod in the longitudinal direction.

19. The method according to claim 18, wherein the first adhesive weight is 1.5 to 3 times the second adhesive weight.

20. The method according to claim 18, wherein the smoking article has the tobacco rod at the leading end; and in a step of A', a non-adhesive portion is provided at the leading end of the tipping paper, which is defined as a tipping paper region positioned over the end of the tobacco rod when the tipping paper is wrapped around the composite segment.

21. The method according to claim 18, wherein in a step of A', a non-adhesive portion is provided in a region for wrapping the cooling segment.

22. The method according to claim 18, wherein the composite segment in a step of B' is prepared by placing a pair of the composite segments such that filter segment end faces come into contact with each other.

23. The method according to claim 22, wherein a non-adhesive portion is provided near a region in the tipping paper for wrapping a contact part between the filter segment end faces.

24. The method according to claim 21, further comprising providing a hole in the non-adhesive portion.

25. The method according to claim 21, further comprising performing printing in the non-adhesive portion.

26. The method according to claim 18, wherein the tobacco rod has a diameter larger than a than an immediately adjacent member.

27. The method according to claim 26, wherein the tobacco rod has a diameter 0.05 to 0.15 mm larger than the immediately adjacent member.

28. The method according to claim 26, wherein the tobacco rod has a diameter 0.5 to 2.5% larger than the immediately adjacent segment.

29. The method according to claim 18, wherein the member immediately adjacent the tobacco rod has stiffness higher than the tobacco rod.

30. The method according to claim 18, wherein the member immediately adjacent the tobacco rod is the cooling segment or a support segment.

31. A smoking article comprising, as members, at least a tobacco rod, a cooling segment, a filter segment, and a tipping paper for wrapping the tobacco rod, the cooling segment, and the filter segment, wherein the tipping paper has each portion of a first adhesive weight and a second adhesive weight per unit area after solidification, the first adhesive weight being greater than the second adhesive weight; and the tipping paper includes the portion of the first adhesive weight in a region for wrapping the tobacco rod, wherein the portion of the first adhesive weight is provided in a region extending from a contact face between the tobacco rod and a member immediately adjacent the tobacco rod to a 20 to 40% position of the tobacco rod in the longitudinal direction.

32. The smoking article according to claim 31, wherein the first adhesive weight is 1.5 to 3 times the second adhesive weight.

33. The smoking article according to claim 31, wherein the tipping paper has a non-adhesive portion in a region for wrapping the cooling segment.

34. The smoking article according to claim 31, wherein the tipping paper has a non-adhesive portion in a region for wrapping the filter segment.

35. The smoking article according to claim 31, wherein a member immediately adjacent the tobacco rod is the cooling segment or a support segment.

* * * * *